US006153545A

United States Patent [19]

LaLonde et al.

[11] Patent Number: 6,153,545

[45] Date of Patent: Nov. 28, 2000

[54] TECHNICAL FABRICS FOR AIRBAGS

[75] Inventors: Rémi LaLonde, Emmenbruecke; Franz Hurschler, Rottenburg, both of Switzerland

[73] Assignee: Rhodia Filtec AG, Emmenbruecke, Switzerland

[21] Appl. No.: 09/331,879

[22] PCT Filed: Jan. 12, 1998

[86] PCT No.: PCT/CH98/00009

§ 371 Date: Jun. 28, 1999

§ 102(e) Date: Jun. 28, 1999

[87] PCT Pub. No.: WO98/31854

PCT Pub. Date: Jul. 23, 1998

[30] Foreign Application Priority Data

Jan. 20, 1997 [CH] Switzerland ..... 98/97

[51] Int. Cl.[7] ..... D01F 6/00

[52] U.S. Cl. ..... 442/189; 428/397; 428/399

[58] Field of Search ..... 442/189; 428/397, 428/399; 280/743.2

[56] References Cited

U.S. PATENT DOCUMENTS

| | | | |
|---|---|---|---|
| 5,100,729 | 3/1992 | Jacob et al. | 428/370 |
| 5,146,738 | 9/1992 | Greifeneder et al. | 57/207 |
| 5,188,892 | 2/1993 | Grindstaff | 428/399 |
| 5,344,710 | 9/1994 | Jacob et al. | 428/399 |
| 5,424,123 | 6/1995 | Geirhos et al. | 428/399 |
| 5,429,868 | 7/1995 | Truckenmuller et al. | 428/399 |
| 5,470,106 | 11/1995 | Nishimura et al. | 280/743.1 |
| 5,607,183 | 3/1997 | Nishimura et al. | 280/743.1 |

FOREIGN PATENT DOCUMENTS

| | | |
|---|---|---|
| 0 022 065 | 1/1981 | European Pat. Off. . |
| 1-104848 | 4/1989 | Japan . |

*Primary Examiner*—Newton Edwards
*Attorney, Agent, or Firm*—Michael J. Striker

[57] ABSTRACT

The woven fabric for an airbag, a filter, a sail, a parachute or a paraglider is woven from a multifilament yarn having a yarn linear density between 30 and 1000 dtex. The multifilament yarn is a mixture of coarse filaments having a linear density of 5.5 to 8 dtex and fine filaments having a linear density of 2.5 to 4 dtex. The coarse filaments are mixed with the fine filaments in a ratio of from 1:1 to 1:5. The yarn can be made by a melt-spinning method using a spinneret with coarse holes and fine holes for the coarse and fine filaments disposed in an alternating arrangement. The filament may be made of polyamide, polyester or polypropylene.

5 Claims, 2 Drawing Sheets

TECHNICAL FABRICS FOR AIRBAGS

BACKGROUND OF THE INVENTION

1. Field of the Invention

The present invention relates to industrial woven fabrics, especially for airbags, consisting of a filament yarn comprising coarse and fine thermoplastic filaments and having a yarn linear density between 30 and 1000 dtex, and to a process for producing the filament yarn.

2. Prior Art

Industrial woven fabrics, especially airbag woven fabrics, are produced using filament yarns composed of polyamides or polyesters and having a yarn linear density between about 50–750 denier (56–830 dtex), according to JP-A-01-104848. Such yarns can also consist of mixtures of different raw materials. Air permeability has been reduced in various ways. One way is to coat the woven fabrics with an elastomer. Such woven fabrics are generally stiff, heavy and complicated to produce. Owing to the high production costs, the reduced foldability and the limited recyclability, this solution has not been found to be very suitable. Another proposal is the production of uncoated woven fabrics in a closer weave and/or adapted finishing processes. With regard to foldability and weight, however, these wovens were not satisfactory. Air permeability can also be improved by calendering the woven fabrics, but this has the disadvantage of additional process steps and of impairment to the mechanical properties such as tenacity and tear strength in the warp and weft directions.

The production of a mixed linear density yarn having a yarn linear density of 50 to 800 dtex is also known from EP-A-0 022 065. The yarn, produced using a spinneret having different holes for coarse and fine filaments, is false twist textured and is said to exhibit a spunlike effect. It is intended for loose textile applications. It consists of a core filament group having a relatively coarse linear density and a sheath filament group having a relatively fine linear density, which surrounds the core group, and also not more than two further filaments having a filament linear density between 4.0 and 10 dtex. The spunlike yarn is not suitable for producing woven fabric possessing low air permeability and good tear strength.

Optimization in the direction of lower air permeability on the one hand and good foldability and low weight on the other have hitherto only been possible to a limited extent, since a high tensile strength and a (especially for airbags) high tear strength is not ensured. More particularly, lighter woven constructions exhibit a particularly high loss of tear strength.

SUMMARY OF THE INVENTION

It is an object of the present invention to provide a woven fabric which exhibits low air permeability, is light and supple and which nonetheless exhibits improved tensile strength, especially improved tear strength.

It is a further object to provide a process for producing the filament yarn.

This object is achieved according to the invention when the coarse filaments of the filament yarn have a filament linear density of 5 to 14 dtex, especially of 5.5 to 8 dtex, preferably 6 to 8 dtex, and the fine filaments have a filament linear density of 1.5 to 5 dtex, especially 2.5 to 4 dtex, preferably 3 to 4 dtex.

It was surprisingly found that a mixed linear density yarn having a yarn linear density between 30 and 1000 dtex, preferably between 200 and 950 dtex, i.e. a yarn consisting of a mixture of relatively fine and relatively coarse individual filaments, is particularly suitable particularly for the industrial use for airbag woven fabric with regard to the combination of air permeability and hence filtration capability, softness and foldability.

The coarse filaments contribute to improving the tensile strength and hence the tear strength. The fine filaments ensure good foldability and hence lower flexural stiffness and hence better softness and suppleness. These advantages, especially the softness and the suppleness, result in better foldability in the case of both uncoated and coated woven fabrics. The mixture of coarse and fine filaments contributes to a lower air permeability through the arrangement of the individual filaments in the woven fabrics. Lighter woven fabrics simultaneously acquire better seam strength thanks to the blocking effect of the individual filaments or of the yarn structures, such as trilobal or other multilobal configurations. Thanks to the high hiding power of the fine filaments, it is possible to use lower thread counts in the woven fabrics while retaining a high tensile strength/tear strength.

It has proven to be particularly advantageous for the coarse filaments and the fine filaments of the yarn to be used in a very uniform mixture in a ratio of 1:1 to 1:5. A ratio of less than 1:1 will result in too few fine filaments being present, making the woven fabrics too air permeable, too stiff and insufficiently readily foldable. At a ratio above 1:5, too few coarse filaments are present, the woven fabrics is admittedly supple, but the tear strength is insufficient.

It is advantageous to produce these yarns from a polyamide, a polyester or polypropylene or copolymers thereof.

It is further advantageous to entangle the multifilaments used, air entanglement with 25–40 nodes per meter being most suitable.

The mixed yarn is produced by melt spinning through spinnerets in which the coarse holes for the coarse filaments and fine holes for the fine filaments are disposed in an alternating arrangement. This has the advantage that mixing of the coarse with the fine filaments takes place even before the entanglement. In general, a unitary polymer is used.

BRIEF DESCRIPTION OF THE DRAWINGS

The yarn of the invention will now be more particularly described with reference to a drawing, in which.

DESCRIPTION OF THE PREFERRED EMBODIMENTS

Figure 1:
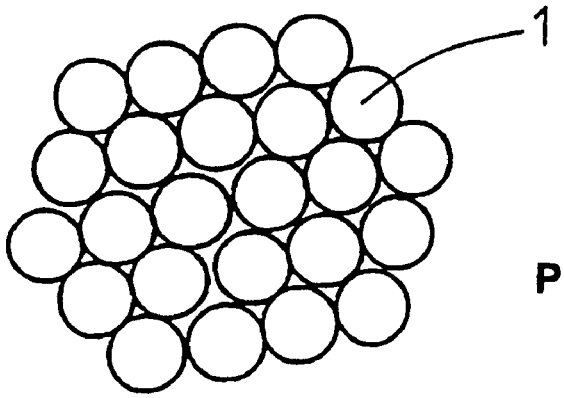
Fig. 1 PRIOR ART
FIG. 1 is a diagrammatic cross-sectional view through a filament yarn according to the prior art.

FIG. 1 shows a prior art yarn, bearing reference numeral 1, of a filament bundle in cross section. The individual filaments 1 have an identical round diameter.

Figure 2:
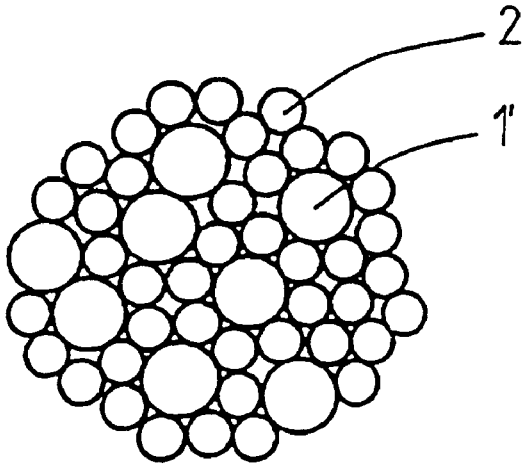
FIG. 2 is a diagrammatic cross-sectional view through the mixed yarn according to the invention.

FIG. 2 shows a bundle of coarse filaments 1' and fine filaments 2. The filaments 1', 2 are distributed across the entire cross-sectional area.

Figure 3:
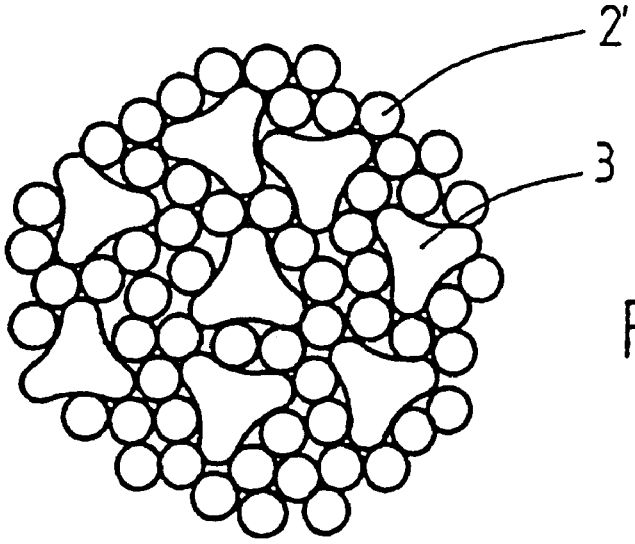
FIG. 3 is a diagrammatic cross-sectional view through a variant of the mixed yarn according to the invention.

FIG. 3 shows a bundle of coarse filaments 3 and fine filaments 2'. The coarse filaments can be trilobal or multilobal.

Figure 4:
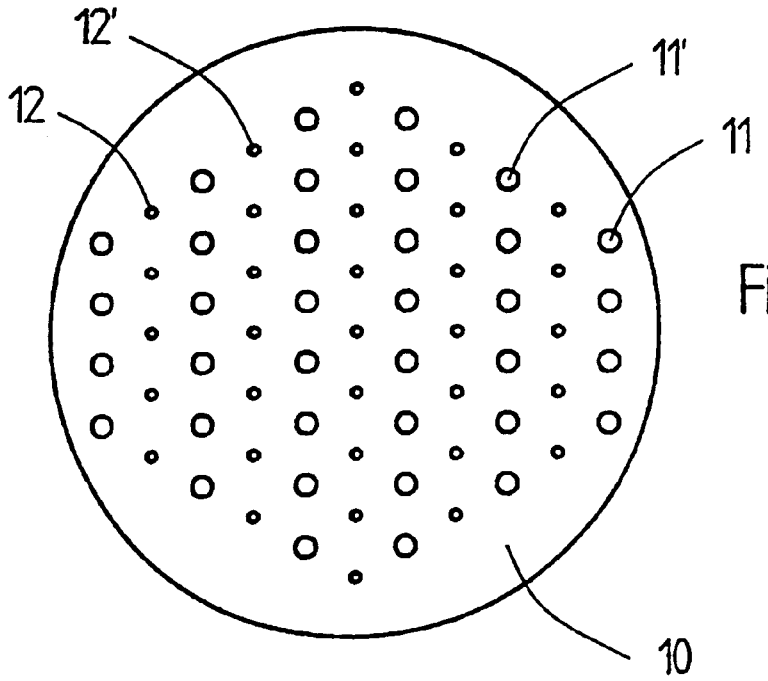
FIG. 4 is a diagrammatic plan view of a spinneret for producing the yarn according to the invention.

FIG. 4 shows the plan view of the exit side of a spinneret plate 10. The coarse holes for coarse filaments are signified 11 and 11'; fine holes for fine filaments are each signified 12 and 12'. The reference numeral 11 or 12 represents a series or an entire bundle or a group of similar holes. An essential feature is the alternating arrangement, whereby good mixing of the coarse and fine filaments is achieved in the yarn.

Figure 5:
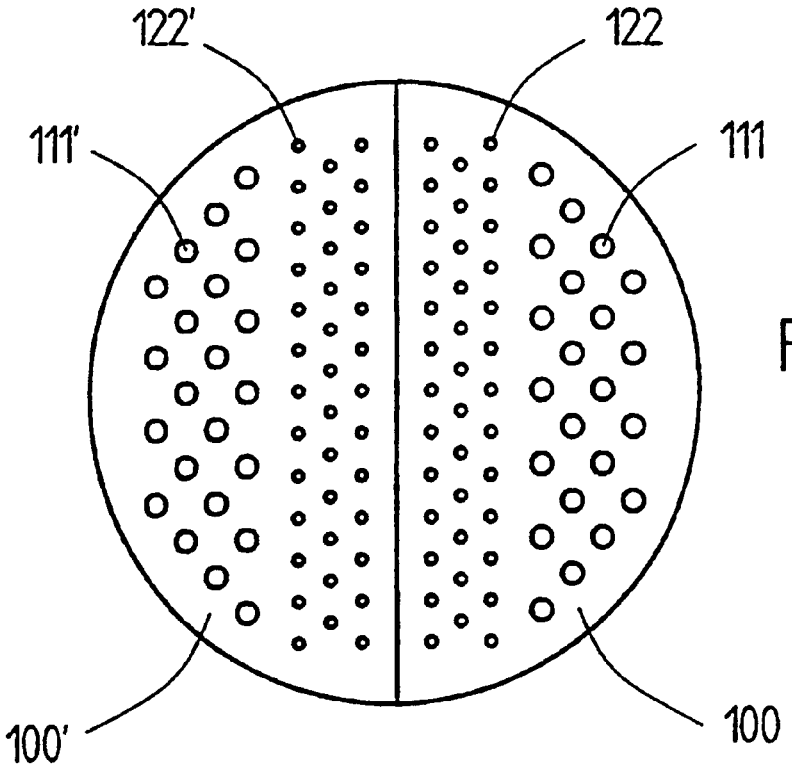
FIG. 5 is a diagrammatic plan view of a variant of a spinneret.

FIG. 5 shows a variant of the arrangement of the holes featuring a right hand side of a spinneret plate 100 and a left hand side of the spinneret plate 100', for example two end spinning, according to FIG. 4. A hole 111 or 111' represents in each case a group of similar holes for coarse filaments. A hole 122 or 122' represents a group of similar holes for fine filaments.

The invention will now be more particularly described with reference to an inventive example (No. 3) and two comparative examples (No. 1 and No. 2). The spinning and drawing conditions were identical in all examples. The results are summarized in Table 1.

EXAMPLES

Three wovens fabrics were likewise produced under identical conditions:

The weaving in a plain weave was carried out on a gripper machine using 18 ends/cm and 17.5 picks/cm. This was followed by a treatment in a chamber with saturated steam at temperatures above 100° C. The drying/setting of the wovens fabrics took place on a tenter.

TABLE 1

| | 1 | | 2 | | 3 | |
|---|---|---|---|---|---|---|
| Yarn dtex | 470 | | 470 | | 470 | |
| Filament count | 68 | | 136 | | 102 | |
| Filament dtex | 6.9 | | 3.5 | | mixed 3.5 & 6.9 | |
| Entanglement (nodes/cm) | 30 | | 30 | | 30 | |
| Construction | plain | | plain | | plain | |
| | Warp | Weft | Warp | Weft | Warp | Weft |
| Threads/cm | 20 | 20 | 20 | 20 | 20 | 20 |
| Tensile strength (N/5 cm) | 3120 | 3190 | 3010 | 3050 | 3100 | 3100 |
| Elongation at break (%) | 40 | 33 | 38 | 30 | 38 | 31 |
| Tear strength (N) | 154 | 157 | 124 | 132 | 150 | 152 |
| Flexural stiffness (mN) | 47.3 | 54.7 | 42.7 | 49.5 | 43.2 | 50.1 |
| Air permeability ($l/dm^2/mn$) | 16.8 | | 5.5 | | 6.0 | |
| Weight | 215 | | 218 | | 210 | |

It is surprising that tensile strength and tear strength of the woven fabric of the invention are significantly higher than those of Comparative Example 2 for a similar air permeability and lower weight.

Methods of Measurement: DIN

Number of threads per cm: 53 853

Tensile strength: 53 857

Elongation at break: 53 857

Tear strength: 53 859

Air permeability: 53 887

Weight: 53 854

Flexural stiffness: 53 121

The wovens fabrics of the invention, whether coated or uncoated, are very useful in airbags. However, they can also be used as wovens fabrics for filters, sails, parachutes and paragliders.

What is claimed is:

1. A woven fabric for an airbag, a filter, a sail, a parachute or a paraglider, said woven fabric comprising a multifilament yarn having a yarn cross-section and a yarn linear density between 30 and 1000 dtex, wherein said multifilament yarn consists of a plurality of individual coarse filaments and a plurality of individual fine filaments, said coarse filaments and said fine filaments are distributed across the cross-section in an alternating arrangement, said coarse filaments have a linear density of 5.5 to 8 dtex, said fine filaments have a linear density of 2.5 to 4 dtex, and said coarse filaments are mixed with said fine filaments in a ratio of from 1:1 to 1:5.

2. The woven fabric as defined in claim 1, wherein said individual coarse filaments and said individual fine filaments are made of polyamide, polyester or polypropylene.

3. The woven fabric as defined in claim 1, wherein the multifilament yarn has an air entanglement of 25 to 40 nodes per meter.

4. The woven fabric as defined in claim 1, wherein said yarn linear density is 470 dtex, said linear density of said coarse filaments is 6.9 dtex, said linear density of said fine filaments is 3.5 dtex, whereby said woven fabric has a tensile strength of 3100 N/cm, an elongation at break for warp of 38%, an elongation at break for weft of 31%, a tear strength for said warp of 150 N, a tear strength for said weft of 152 N, a flexural stiffness for said warp of 43.2 mN, a flexural stiffness for said weft of 50.1 mN and an air permeability of 6.0 $l/dm^2/mn$.

5. A method of making a woven fabric for an airbag, a filter, a sail, a parachute or a paraglider, said woven fabric comprising a multifilament yarn having a yarn cross-section and linear density between 30 and 1000 dtex, wherein said multifilament yarn consists of a plurality of individual coarse filaments and a plurality of individual fine filaments, said coarse filaments and said fine filaments are distributed across the yarn cross-section, said coarse filaments have a linear density of 5.5 to 8 dtex, said fine filaments have a linear density of 2.5 to 4 dtex, and said coarse filaments are mixed with said fine filaments in a ratio of from 1:1 to 1:5, said method comprising melt-spinning through a spinneret having a plurality of coarse holes for said coarse filaments and a plurality of fine holes of said fine filaments disposed in an alternating arrangement, whereby said fine filaments and said coarse filaments are distributed across said cross-section of said multifilament yarn.

* * * * *